US008695975B2

(12) United States Patent
Seki

(10) Patent No.: US 8,695,975 B2
(45) Date of Patent: Apr. 15, 2014

(54) JAM PROCESSING ASSISTING DEVICE AND IMAGE FORMING APPARATUS INCLUDING THE JAM PROCESSING ASSISTING DEVICE

(75) Inventor: Takeo Seki, Kanagawa (JP)

(73) Assignee: Ricoh Company, Limited, Tokyo (JP)

( * ) Notice: Subject to any disclaimer, the term of this patent is extended or adjusted under 35 U.S.C. 154(b) by 0 days.

(21) Appl. No.: 13/400,986

(22) Filed: Feb. 21, 2012

(65) Prior Publication Data

US 2012/0217702 A1 Aug. 30, 2012

(30) Foreign Application Priority Data

Feb. 25, 2011 (JP) ..... 2011-040766

(51) Int. Cl.
*B65H 5/34* (2006.01)

(52) U.S. Cl.
USPC ..... 271/270; 271/265.01; 271/266

(58) Field of Classification Search
CPC ..... B65H 2511/528; B65H 2601/11; B65H 2601/255; B65H 2601/325
USPC ..... 271/265.01, 265.02, 266, 270
See application file for complete search history.

(56) References Cited

U.S. PATENT DOCUMENTS 5,971,388 A * 10/1999 Hattori et al. ..... 271/10.03
6,007,062 A * 12/1999 Choo et al. ..... 271/258.01
6,381,441 B1 * 4/2002 Byeon et al. ..... 399/396
6,390,467 B1 * 5/2002 Fukube ..... 271/256
6,837,489 B2 * 1/2005 Kim ..... 271/3.14
2003/0122296 A1 * 7/2003 Kim ..... 271/3.14
2010/0164171 A1 * 7/2010 Feng ..... 271/264
2010/0194026 A1 * 8/2010 Iguchi ..... 271/3.15
2011/0310168 A1 * 12/2011 Numata ..... 347/29
2012/0217702 A1 * 8/2012 Seki ..... 271/265.01

FOREIGN PATENT DOCUMENTS

JP 2003-005586 A 1/2003
JP 2009-190803 A 8/2009

* cited by examiner

*Primary Examiner* — Kaitlin Joerger
(74) *Attorney, Agent, or Firm* — Harness, Dickey & Pierce

(57) ABSTRACT

A jam-processing assisting device that performs a jam removal process for removing a sheet jammed at a carriage roller by rotating the carriage roller includes: a motor that drives the carriage roller to rotate; a rotation-direction detecting unit that detects a direction of rotation in which the motor is required to rotate for removing a jam; and a motor-driving controlling unit that drives the motor to rotate in the direction that has been detected. The rotation-direction detecting unit determines, based on a detection of a pulling-out direction in which the jammed sheet is pulled by an external force, the pulling-out direction that has been detected as the direction of rotation of the motor and drives the motor in the direction that has been determined.

8 Claims, 5 Drawing Sheets

HALL SIGNAL FOR CLOCKWISE DIRECTION

HALL SIGNAL FOR COUNTER-CLOCKWISE DIRECTION

HALL SIGNAL FOR CLOCKWISE DIRECTION

HALL SIGNAL FOR COUNTER-CLOCKWISE DIRECTION

JAM PROCESSING ASSISTING DEVICE AND IMAGE FORMING APPARATUS INCLUDING THE JAM PROCESSING ASSISTING DEVICE

CROSS-REFERENCE TO RELATED APPLICATIONS

The present application claims priority to and incorporates by reference the entire contents of Japanese Patent Application No. 2011-040766 filed in Japan on Feb. 25, 2011.

BACKGROUND OF THE INVENTION

1. Field of the Invention

The present invention relates to a jam processing assisting device that can perform jam processing with an easy operation, and an image forming apparatus equipped with the jam processing assisting device.

2. Description of the Related Art

In an image forming apparatus using a sheet as a printing medium, jam (paper jam) is likely to occur on a sheet conveying path while a sheet is being conveyed. In many cases, the jammed sheet is stuck between paper carriage rollers. Accordingly, a strong force is required in removing the jammed sheet from the image forming apparatus because a heavy load is applied to the sheet at the time the sheet is extracted from between the carriage rollers. Therefore, in order to reduce the force required in the jam processing, a driving device that drives the carriage rollers has been developed. An example is an auxiliary device (a jam processing assisting device) for sending out the jammed sheet by rotating a stepping motor (refer to Japanese Patent Application Laid-open No. 2009-190803).

That is, Japanese Patent Application Laid-open No. 2009-190803 discloses a jam-processing assisting device in which a stepping motor drives to rotate carriage rollers in the sheet conveying (downstream) direction so as to facilitate the removal of the jammed sheet. Specifically, the jam-processing assisting device designates from an operation panel a motor configured to drive carriage rollers located at a position where the jam has occurred so as to rotate the motor. When designating the motor, rotation time and rotation distance are also designated.

The jam-processing assisting device is convenient in the jamming processing. However, because the device employs a system in which the motor for driving the carriage rollers is designated from the operation panel, there is still a problem to be solved in that the operation work for using the operation panel is complicated for a user.

The present invention has been made in view of the above-described problem of the jam-processing assisting device of the related art, i.e., there is a need to assist the user to drive carriage rollers with an easy operation during jam processing by eliminating a complicated operation of designating a motor or the like from an operation panel as seen in a jam-processing assisting devices of the related art.

SUMMARY OF THE INVENTION

It is an object of the present invention to at least partially solve the problems in the conventional technology.

A jam-processing assisting device that performs a jam removal process for removing a sheet jammed at a carriage roller by rotating the carriage roller includes: a motor that drives the carriage roller to rotate; a rotation-direction detecting unit that detects a direction of rotation in which the motor is required to rotate for removing a jam; and a motor-driving controlling unit that drives the motor to rotate in the direction that has been detected. The rotation-direction detecting unit determines, based on a detection of a pulling-out direction in which the jammed sheet is pulled by an external force, the pulling-out direction that has been detected as the direction of rotation of the motor and drives the motor in the direction that has been determined.

An image forming apparatus includes a jam-processing assisting device that performs a jam removal process for removing a sheet jammed at a carriage roller by rotating the carriage roller. The jam-processing assisting device includes: a motor that drives the carriage roller to rotate; a rotation-direction detecting unit that detects a direction of rotation in which the motor is required to rotate for removing a jam; and a motor-driving controlling unit that drives the motor to rotate in the direction that has been detected. The rotation-direction detecting unit determines, based on a detection of a pulling-out direction in which the jammed sheet is pulled by an external force, the pulling-out direction that has been detected as the direction of rotation of the motor and drives the motor in the direction that has been determined.

The above and other objects, features, advantages and technical and industrial significance of this invention will be better understood by reading the following detailed description of presently preferred embodiments of the invention, when considered in connection with the accompanying drawings.

BRIEF DESCRIPTION OF THE DRAWINGS

FIG. 2A is a logic table of an output signal for a forward rotation whereas FIG. 2B is a logic table of an output signal for a reverse rotation;

FIG. 4A is a logic table for the forward rotation whereas FIG. 4B is a logic table for the reverse rotation;

FIG. 6A is a logic table for the forward rotation and FIG. 6B is a logic table for the reverse rotation;

FIG. 8A is a logic table for the forward rotation and FIG. 8B is a logic table for the reverse rotation.

DETAILED DESCRIPTION OF THE PREFERRED EMBODIMENTS

Embodiments are described with reference to the accompanying drawings.

A jam-processing assisting device according to the present embodiment is similar to that of the related art in that carriage rollers involved in paper jamming is driven to rotate so as to send out a jammed sheet in jam processing with some differences that are listed as follows: it is not required to use an operation panel in designating a direction of rotation of the carriage rollers involved in the paper jamming as opposed to a jam-processing assisting device of the related art; the direction of rotation in which the carriage rollers are required to rotate is detected when the user slightly pulls the paper in a direction in which the jammed sheet can be easily removed; the motor for driving the carriage rollers is rotated at a speed slower than a normal sheet conveying speed in the detected direction until the jammed sheet is completely removed, thereby automatically assisting the jam processing.

Figure 1:
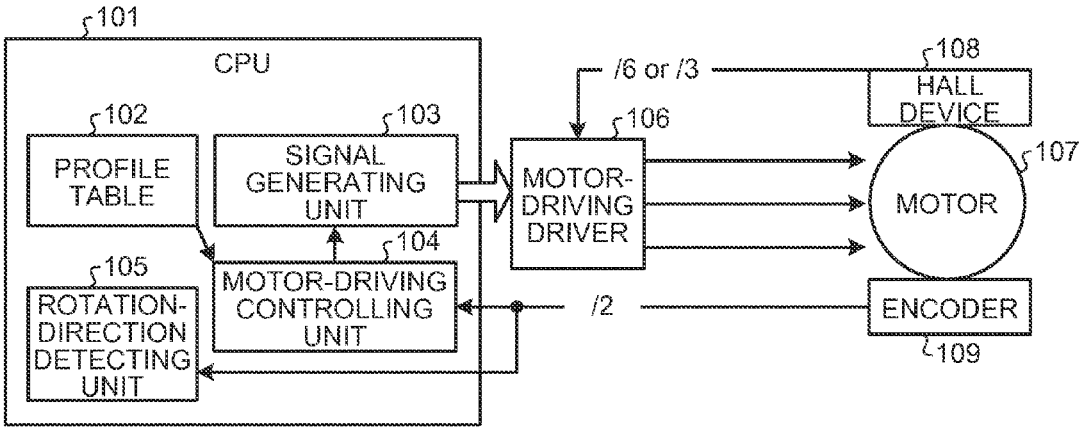
FIG. 1 is a diagram schematically illustrating a jam-processing assisting device that uses an encoder signal according to an embodiment.

FIG. 1 is a diagram schematically illustrating a jam-processing assisting device that uses an encoder signal according to the embodiment.

As illustrated in FIG. 1, the jam-processing assisting device includes a central processing unit (CPU) 101, a motor driver 106, a motor 107, a Hall device 108, and an encoder 109.

The CPU 101 includes, as function implementing means, a profile table 102 in which a speed profile is stored, a signal generating unit 103 that generates a motor-driving signal, a motor-driving controlling unit 104 that controls the driving of the motor, and a rotation-direction detecting unit 105 that detects a direction of rotation when a jam occurs. The CPU 101 performs processing in normal rotation mode and jam releasing mode in accordance with a computer program installed therein.

The profile table 102 is configured as a read only memory (ROM) that stores a speed profile in the normal rotation mode and a slow rotation speed profile in the jam processing mode. The signal generating unit 103 generates driving signals for driving the motor 107, such as a pulse width modulation (PWM) signal, a rotation direction signal, an enable signal, and a braking signal.

The motor-driving controlling unit 104 compares a target speed stored in the profile table 102 and a rotation position of the motor 107 with a signal output from the encoder 109, and performs control such as feedforward control or feedback control.

The rotation-direction detecting unit 105 detects a direction of rotation that is obtained when the user slightly pulls the sheet during the jam processing.

The motor driver 106 is a driver for driving the motor 107 and outputs a driving signal after obtaining motor rotation information from the Hall device 108.

The motor 107 is a power source for rotating the carriage rollers. As the motor 107, a three-phase brushless direct current (DC) motor 107 (hereinafter, simply referred to as "motor 107") is used in this embodiment. The Hall device 108 outputs a signal in accordance with a rotation angle of the motor 107. Number of Hall signals output from the Hall device 108 is six for an analog Hall device and three for the output from a Hall IC.

In the encoder 109, a two-phase encoder signal generating unit is attached to a motor shaft.

Alternatively, the two-phase encoder signal generating unit may be provided at a portion that may be driven along with the motor shaft, instead of the motor shaft, if an installation thereof to the portion can be accomplished easily. Two-phase encoder signals are input into the motor-driving controlling unit 104 so as to be used for the feedback control.

The two-phase encoder signals are also input into the rotation direction detecting unit 105. When a jam occurs and the user pulls the jammed sheet, the driving roller that has caused the jamming is rotated, thereby causing the motor shaft to rotate. Therefore, the encoder 109 attached to the motor shaft outputs the two-phase encoder signals that are used as a rotation-direction detecting means.

Figure 2A:
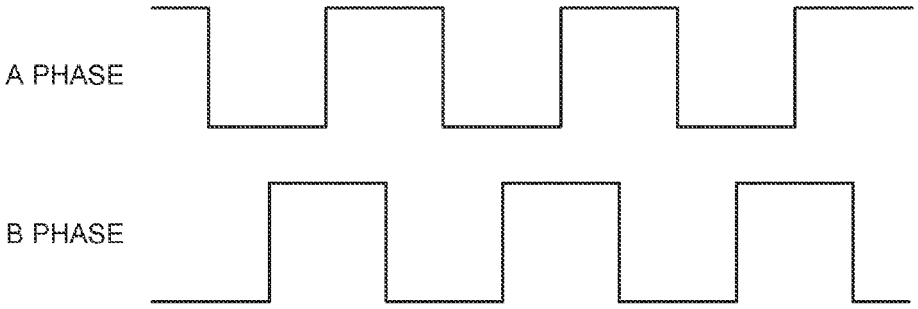
FIGS. 2A and 2B are logic tables of output signals when a motor and an encoder are used in combination.
Figure 2B:
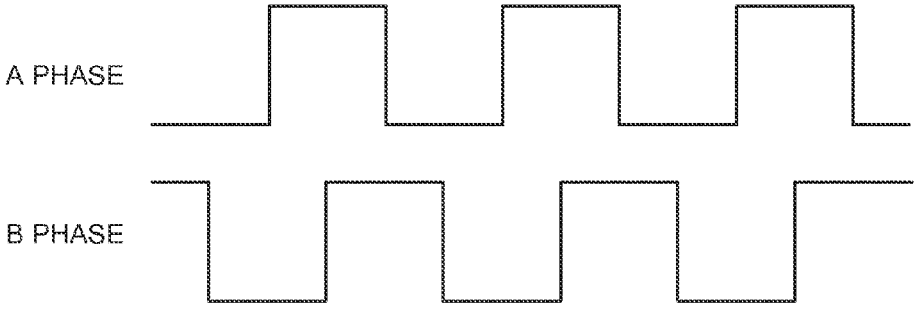

FIGS. 2A and 2B are diagrams for explaining an output signal when a motor 107 and an encoder sensor are used in combination. FIG. 2A illustrates an output signal for a forward rotation and FIG. 2B is an output signal for a reverse rotation.

As illustrated in FIGS. 2A and 2B, it is understood that the patterns of the output signals of A phase and B phase, which are outputs of the encoder, change with the direction of rotation, i.e., depending on the direction of rotation of the motor 107, the patterns of the output signals of the A phase and the B phase interchange therebetween. As such, the direction of rotation of the motor 107 can be detected. That is, in this embodiment, the direction of rotation of the motor 107 is detected using the two-phase encoder signals.

Figure 3:
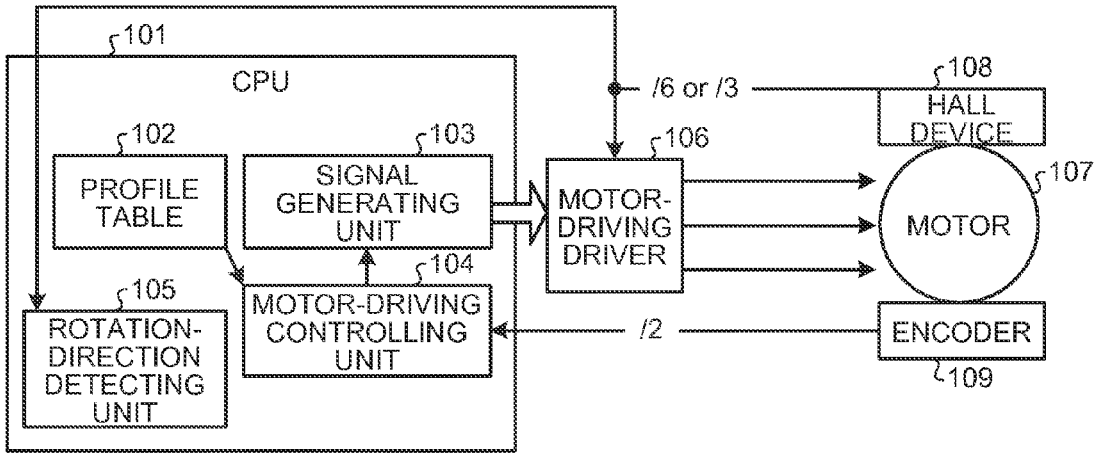
FIG. 3 is a functional block diagram of a jam-processing assisting device that uses a Hall signal.

FIG. 3 is a functional block diagram illustrating a jam-processing assisting device that uses a Hall signal.

The jam-processing assisting device according to the embodiment is different from the jam-processing assisting device illustrated in FIG. 1 in that, the signal input into the rotation-direction detecting unit 105 is a Hall signal output from the Hall device 108 of the motor 107 in the embodiment; however, in other respects, both of the jam-processing assisting devices are similar to each other. Here, according to the rotation angle of the motor 107, the Hall device 108 outputs signals of three phases, with which the direction of rotation of the motor 107 can be detected.

Figure 4A:
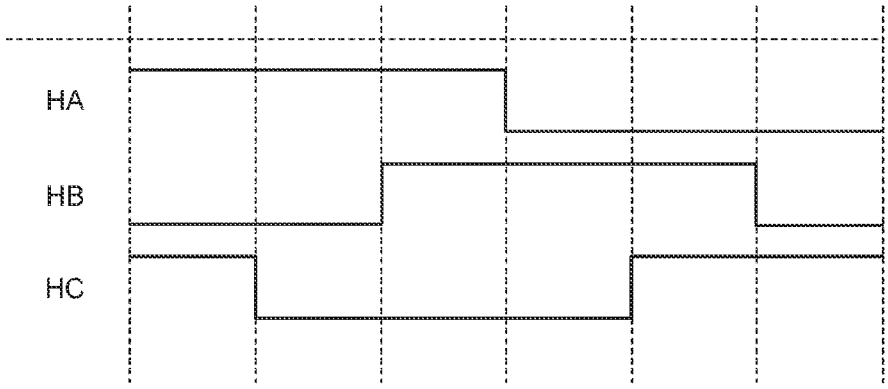
FIGS. 4A and 4B are logic tables indicating the relation between a direction of rotation of the motor and the Hall signal when a Hall IC is used as a Hall device.
Figure 4B:
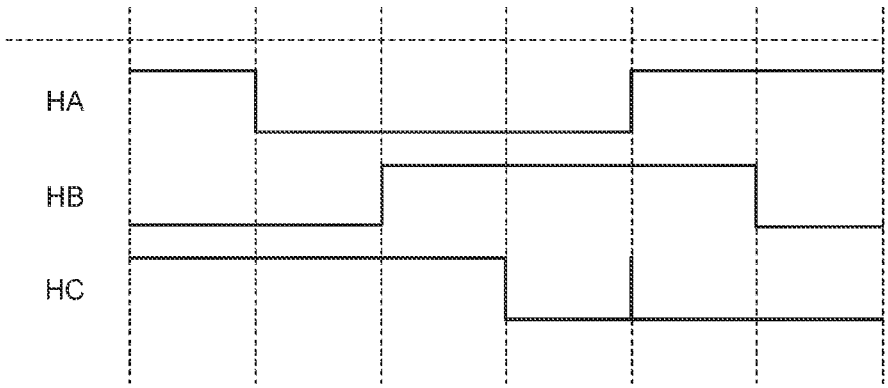

FIGS. 4A and 4B are diagrams illustrating output patterns (logic tables) of the Hall signals and rotation directions of the motor 107 when a Hall IC is used as the Hall device 108 of the motor 107, and FIG. 4A illustrates an output pattern for a forward rotation whereas FIG. 4B illustrates an output pattern for a reverse rotation.

As illustrated in FIGS. 4A and 4B, the Hall signals output from the Hall IC includes three phases, that is, HA phase, HB phase, and HC phase. Viewing the states of the FIGS. 4A and 4B, the HB phase displays the same pattern regardless of the direction of rotation, but the HA phase and the HC phase exhibit an interchange in the patterns depending on the direction of rotation. The direction of rotation of the motor 107 can be detected by using the difference in the combination of the patterns in the three phases.

Figure 5:
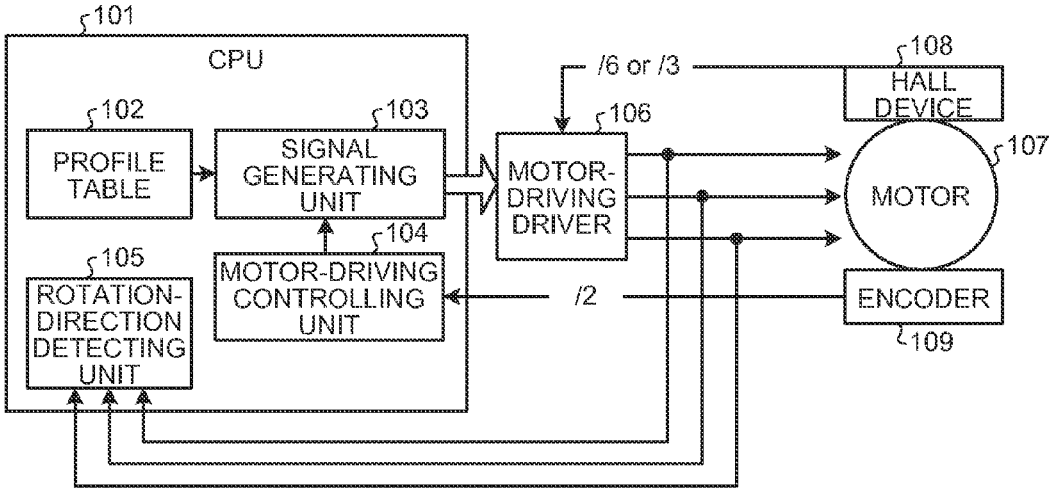
FIG. 5 is a functional block diagram illustrating a jam-processing assisting device that uses a voltage signal at an end of a coil of the motor.

FIG. 5 is a functional block diagram of a jam-processing assisting device that uses a coil-end voltage signal of the motor 107.

The jam-processing assisting device according to the embodiment is different from the jam-processing assisting device illustrated in FIG. 1 in that the signal input into the rotation-direction detecting unit 105 is the coil-end voltage signal of the motor 107; however, in other respects, both of the jam-processing assisting devices are similar to each other.

In the jam-processing assisting device according to the embodiment, when the user pulls the jammed sheet, a roller and the motor 107 that drives the roller, rotates together. At this time, counter electromotive voltages (Hall signals) of three phases (U phase, V phase, and W phase) are generated at an end of a coil of the motor 107 by an external force that rotates the motor 107. Accordingly, by detecting the relation among the three phases of the counter electromotive voltages, the direction of the rotation in which the motor 107 has been caused to rotate by the external force can be detected. At this time, the voltage applied to the motor 107 has to be turned OFF; otherwise, the counter electromotive voltages cannot be monitored.

Figure 6A:
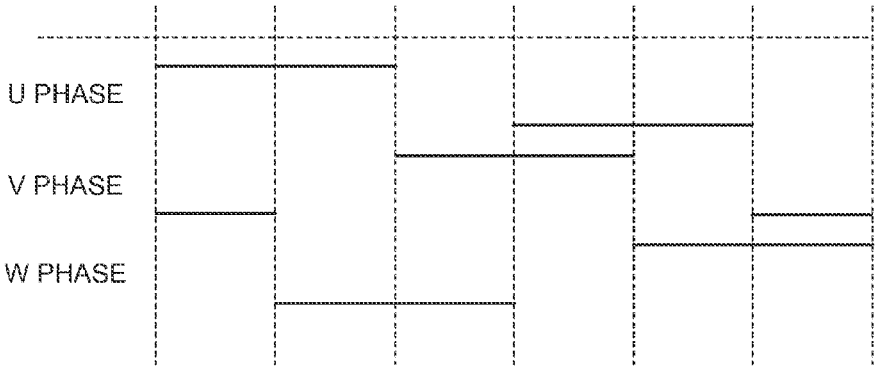
FIGS. 6A and 6B are logic tables indicating the relation between the direction of rotation of the motor and a voltage at the end of the coil.
Figure 6B:
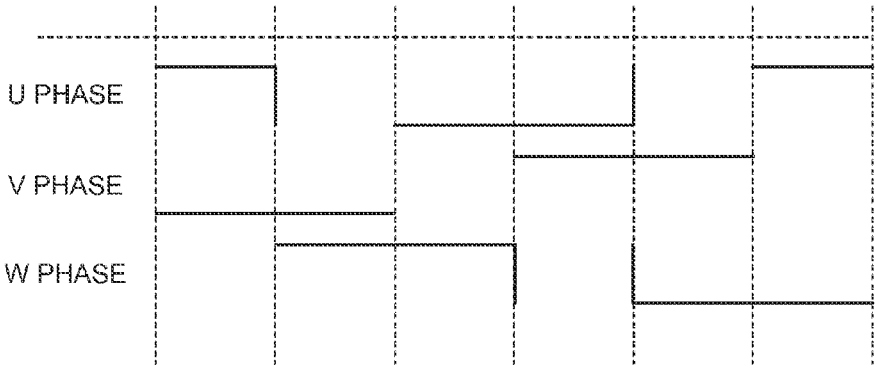

FIGS. 6A and 6B are logic tables showing the relation between a direction of rotation of the motor 107 and coil-end voltage. As illustrated in FIGS. 6A and 6B, a pattern of a coil voltage (coil signal) changes with the direction of rotation of the motor 107 for each of the U phase, V phase, and W phase. Due to the change of the pattern, the direction of rotation can be detected through the counter electromotive voltage signal generated at the end of the coil of the motor 107.

Figure 7:
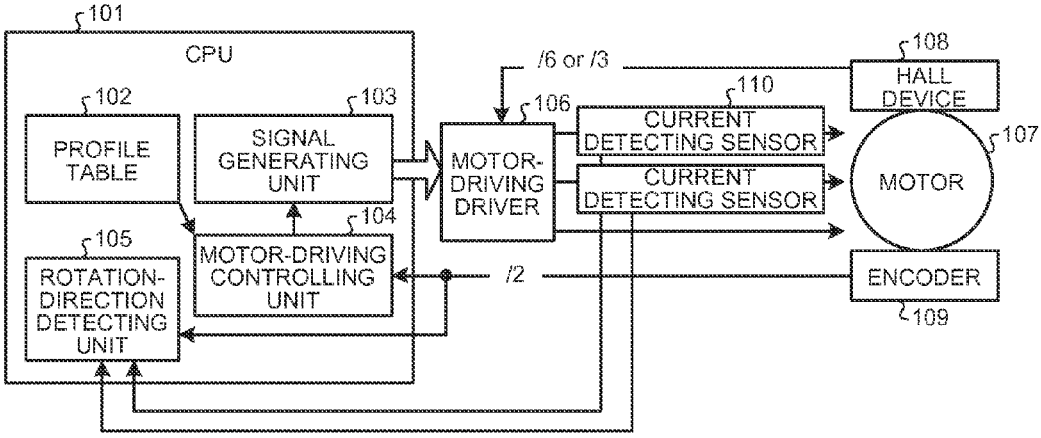
FIG. 7 is a functional block diagram illustrating a jam processing assisting device that uses a coil current.

FIG. 7 is a functional block diagram of a jam-processing assisting device that uses a coil current.

The jam-processing assisting device according to the embodiment is different from the jam-processing assisting device illustrated in FIG. 1 in that a signal input into a rotation-direction detecting unit 105 is a current signal flowing through a motor coil. Accordingly, the jam-processing assisting device according to the embodiment and the jam-processing assisting device illustrated in FIG. 1 have the same configuration except that a current detecting sensor 110 is connected to the end of the motor coil in the jam-processing assisting device according to the embodiment.

In the jam-processing assisting device according to the present embodiment, when the user pulls the jammed sheet, the motor 107, which drives carriage rollers involved in the jamming, is rotated along with the rotation of the carriage rollers. At this time, because the motor 107 is rotated by the external force, a counter electromotive voltage is generated at the end of the coil of the motor 107. Because the counter electromotive voltage generates electric current that flows, the direction in which the motor 107 is rotated by the external force can be detected from the direction of the electric current.

Here, because a current detecting sensor 110 is used to measure the magnitude and direction of the electric current, a current detecting sensor that makes use of the Hall effect (magnetism-to-voltage conversion) may be used, for example. The direction of the electric current can be detected by monitoring two phases of the output signals among the three phases of the output signals of the motor 107 with the current detecting sensor 110.

Figure 8A:
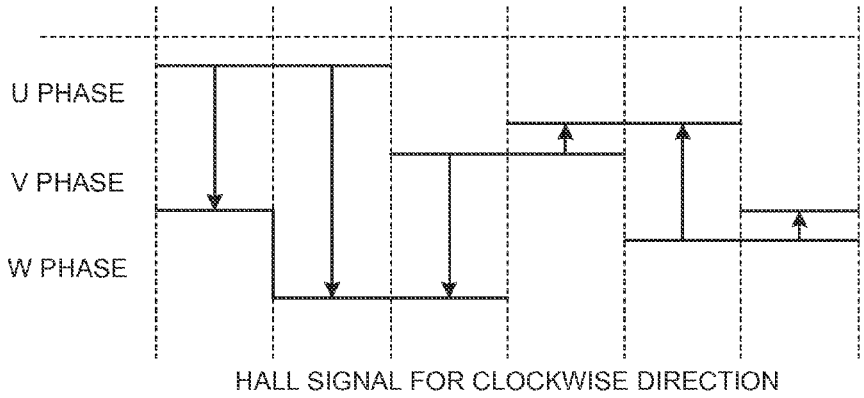
FIGS. 8A and 8B are logic tables indicating the relation between the direction of rotation of the motor and a direction of the coil current.
Figure 8B:
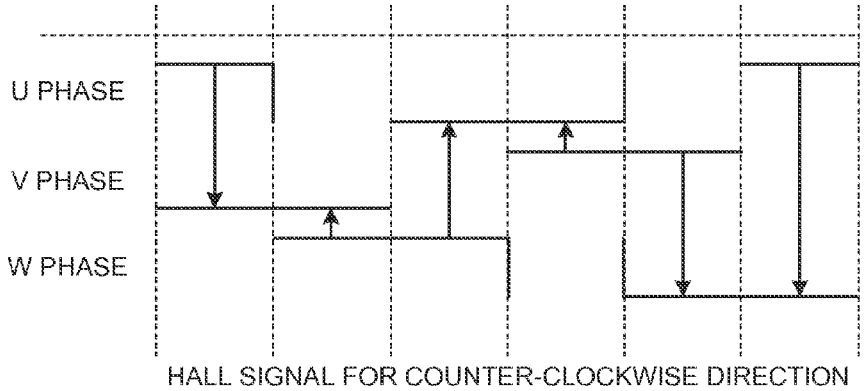

FIGS. 8A and 8B are logic tables showing the relation between a direction of rotation of the motor 107 and a current direction of the coil. FIG. 8A illustrates a current direction of the coil obtained from the Hall signals during the forward rotation and FIG. 8B illustrates a current direction of the coil obtained from the Hall signals during the reverse rotation.

As illustrated in FIGS. 8A and 8B, because the voltage patterns of the electromotive forces of the two phases, the U phase and the V phase, change with the direction of rotation of the motor 107, it is understood that the current direction can be detected if the current detecting sensor 110 is provided only for the U phase and the V phase and not for all of the three phases. Moreover, based on the current direction, the direction of rotation of the motor 107 can be detected.

At this time, too, the voltage applied to the motor 107 has to be turned OFF; otherwise, the counter electromotive voltages cannot be monitored.

Next, a jam-processing assisting procedure in the above-described jam-processing assisting device is described.

Figure 9:
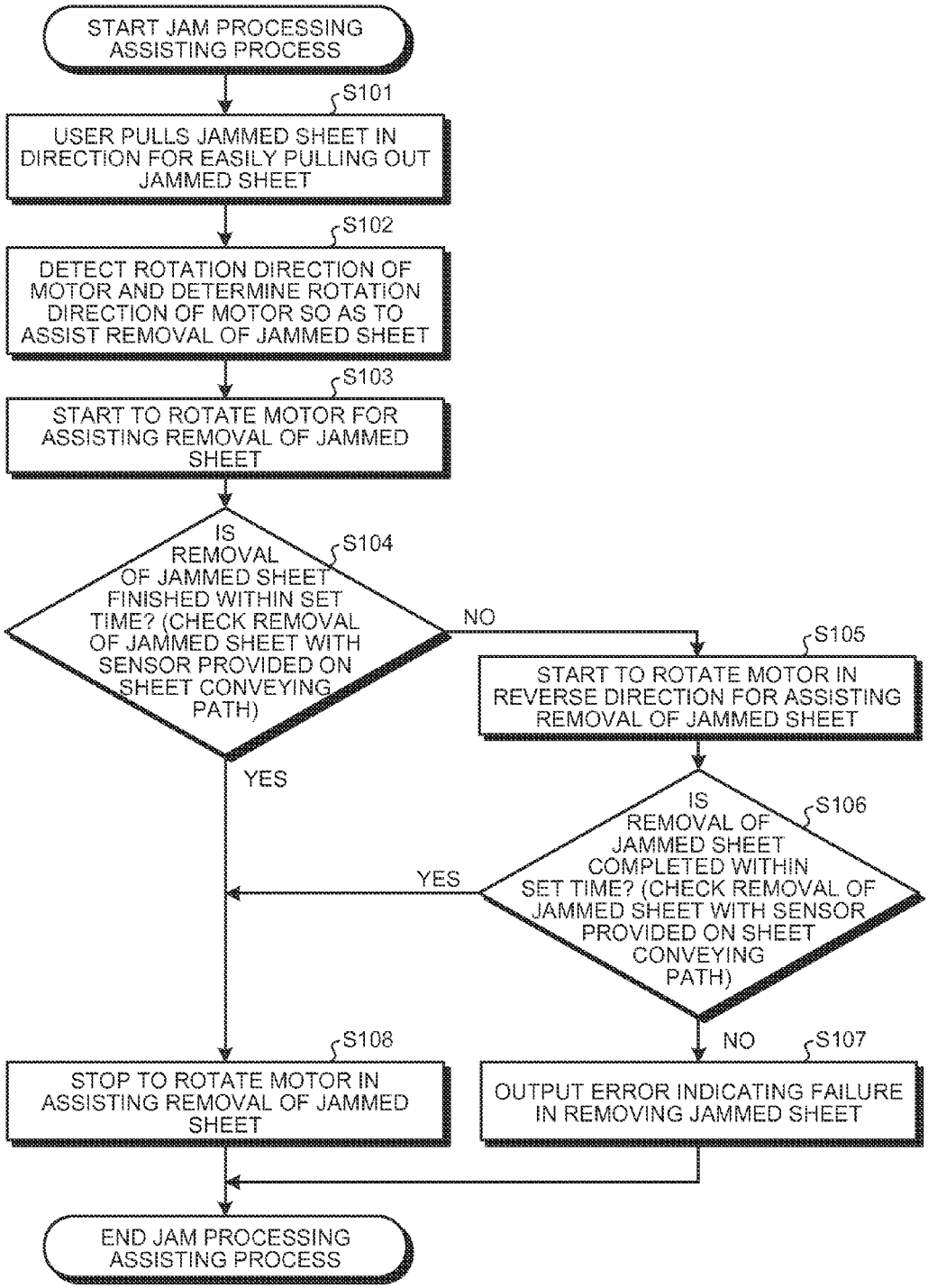
FIG. 9 is a flow diagram explaining a sequence for performing a jam-processing assisting process by the jam-processing assisting device.

FIG. 9 is a flow diagram describing the procedure of a jam-processing assisting process performed by the jam-processing assisting device.

In an image forming apparatus, when a sheet is jammed between carriage rollers, the user pulls the jammed sheet in a direction for easily pulling out the jammed sheet at an early stage of jam processing (Step S101). A pulling process of pulling the jammed sheet in the direction for easily pulling out the jammed sheet is performed because a direction of rotation of a motor 107 for assisting the jam processing at this stage cannot be uniquely determined because there are various cases to be considered regarding the jammed state (for example, a position where the sheet can be easily picked up, a tearing degree of the sheet, a folded degree of the sheet, and the like).

Next, the direction in which the user pulls the jammed sheet is detected. The detecting means are described above with reference to FIGS. 1 to 7.

When the direction of rotation of the motor 107 is determined (Step S102), the rotation of the motor 107 is started (Step S103). Then, the motor 107 is rotated for a predetermined period of time at a predetermined rotation speed (a speed lower than a normal sheet-conveying speed) that is determined in advance for completing the jam processing. A jam removal, i.e., the completion of the jam processing, is detected by a sensor (not illustrated) provided on a sheet conveying path (Step S104). In this case, if the removal of the jammed sheet is not completed within the set time, that is, if the completion of the jam processing is not detected by the sensor (No in Step S104), the motor 107 is started to rotate in a reverse direction so as to assist the removal of the jammed sheet (Step S105).

Next, it is determined whether or not the jammed sheet is removed within a newly set time (Step S106). When it is determined that the jammed sheet is not removed (No in Step S106), an error output process for indicating failure in the removal of the jammed sheet is performed (Step S107), and the jam processing assisting process is ended.

When it is determined that the jammed sheet is removed in Step S106 (Yes in Step S106), the rotation of the motor 107 that assists the removal of the jammed sheet is stopped (Step S108), and the jam processing assisting process is ended.

In the jam processing, the motor 107 is rotated for a predetermined time so as to ensure the effect of the safety function by setting the duration of rotating the motor 107 to a predetermined time because the jammed sheet may be entangled in the carriage rollers and the motor 107 may be locked accordingly.

The predetermined time is determined based on the size of the jammed sheet. That is, the size of the sheet that is conveyed and a rotation speed of the motor 107 that is set are obtained by an image processing apparatus. Accordingly, the time required for the jam processing of the sheet can be calculated. That is, time setting [sec]=the length of the paper in the sheet conveying direction [m]/assisting speed (in the line direction) [m/sec]+margin [sec].

Instead of the time setting, as an alternative safety measure, a safety function using the relation between an output of the signal generating unit 103 and an encoder signal of the encoder 109 is implemented. For example, if no signal of response is obtained from the encoder 109 even when the signal generating unit 103 outputs a signal (for example, PWM signal) for rotating the motor 107 to the motor driver 106, it is determined that an error has occurred.

When assistance in removing the jammed sheet ends up with failure, an error massage may be output to an operation panel or the like according to the flow.

According to the embodiment, when the user uses a jam-releasing assisting function, the user can easily manage to perform jamming processing by driving the motor 107 for the paper carriage rollers without designating the motor 107 or the like from the operation panel. Accordingly, the embodiment may be applied to an image forming apparatus that does not include an operation panel.

Although the invention has been described with respect to specific embodiments for a complete and clear disclosure, the appended claims are not to be thus limited but are to be construed as embodying all modifications and alternative constructions that may occur to one skilled in the art that fairly fall within the basic teaching herein set forth.

What is claimed is:

1. A jam-processing assisting device configured to perform a jam removal process for removing a sheet jammed at a carriage roller by rotating the carriage roller, the jam-processing assisting device comprising:

a motor configured to drive the carriage roller to rotate;

a rotation-direction detecting unit configured to detect a direction of rotation in which the motor is required to rotate for removing a jam; and a motor-driving controlling unit configured to drive the motor to rotate in the direction that has been detected, at a lower speed than a speed with which the motor rotates in a normal sheet conveying mode for a first period of time, wherein the rotation-direction detecting unit determines, based on a detection of a pulling-out direction in which the jammed sheet is pulled by an external force, the pulling-out direction that has been detected as the direction of rotation of the motor and drives the motor in the pulling-out direction that has been determined.

2. The jam-processing assisting device according to claim 1, wherein the motor-driving controlling unit reverses the direction of rotation of the motor and rotates the motor for a second period of time when jam processing has not been completed within the first period of time.

3. The jam-processing assisting device according to claim 1, further comprising:

a unit configured to determine a success or a failure of the jam removal process; and an output unit configured to output an error when the unit determines that the jam removal process has failed.

4. The jam-processing assisting device according to claim 1, wherein the rotation-direction detecting unit detects, based on an output of an encoder sensor that detects a direction of rotation of the motor caused by the external force, the direction of rotation of the motor.

5. The jam-processing assisting device according to claim 1, wherein the rotation-direction detecting unit detects, based on a Hall signal of a Hall device that is provided in the motor and detects a direction of rotation of the motor caused by the external force, the direction of rotation of the motor.

6. The jam-processing assisting device according to claim 1, wherein the rotation-direction detecting unit detects a direction of rotation of the motor based on a counter electromotive voltage generated by a rotation of the motor caused by the external force.

7. The jam-processing assisting device according to claim 1, wherein the rotation-direction detecting unit detects a direction of rotation of the motor based on an electric current due to a counter electromotive voltage generated by a rotation of the motor caused by the external force.

8. An image forming apparatus comprising:

a jam-processing assisting device configured to perform a jam removal process for removing a sheet jammed at a carriage roller by rotating the carriage roller, the jam-processing assisting device including:

a motor configured to drive the carriage roller to rotate;

a rotation-direction detecting unit configured to detect a direction of rotation in which the motor is required to rotate for removing a jam; and a motor-driving controlling unit configured to drive the motor to rotate in the direction that has been detected, at a lower speed than a speed with which the motor rotates in a normal sheet conveying mode for a first period of time, wherein the rotation-direction detecting unit determines, based on a detection of a pulling-out direction in which the jammed sheet is pulled by an external force, the pulling-out direction that has been detected as the direction of rotation of the motor and drives the motor in the pulling-out direction that has been determined.

* * * * *